US010827827B1

(12) United States Patent
Failing

(10) Patent No.: US 10,827,827 B1
(45) Date of Patent: Nov. 10, 2020

(54) ADJUSTABLE HEIGHT STAND AND CASE

(71) Applicant: John R. Failing, Swanton, MD (US)

(72) Inventor: John R. Failing, Swanton, MD (US)

( * ) Notice: Subject to any disclaimer, the term of this patent is extended or adjusted under 35 U.S.C. 154(b) by 0 days.

(21) Appl. No.: 16/436,190

(22) Filed: Jun. 10, 2019

(51) Int. Cl.

| | |
|---|---|
| ***A47B 3/10*** | (2006.01) |
| ***A47B 3/02*** | (2006.01) |
| ***A47B 21/03*** | (2006.01) |
| ***A47B 3/08*** | (2006.01) |
| ***A47B 3/00*** | (2006.01) |
| ***A47B 21/02*** | (2006.01) |

(Continued)

(52) U.S. Cl.

CPC ..... *A47B 3/10* (2013.01); *A47B 3/002* (2013.01); *A47B 3/02* (2013.01); *A47B 3/08* (2013.01); *A47B 3/0818* (2013.01); *A47B 9/00* (2013.01); *A47B 13/08* (2013.01); *A47B 21/02* (2013.01); *A47B 21/03* (2013.01); *A47B 2003/025* (2013.01); *A47B 2200/0001* (2013.01); *A47B 2200/005* (2013.01); *A47B 2200/0043* (2013.01); *A47B 2200/0084* (2013.01)

(58) Field of Classification Search

CPC ..... A47B 3/10; A47B 3/12; A45C 7/0031; A45C 7/0072

USPC ..... 108/35, 33, 34, 36, 38, 39, 41, 44, 45, 108/145; 190/11, 104, 105

See application file for complete search history.

(56) References Cited

U.S. PATENT DOCUMENTS 1,846,607 A * 2/1932 Nicholas ..... A47C 3/38 108/36
2,388,192 A * 10/1945 Stechbart ..... F16M 11/38 108/35

(Continued)

FOREIGN PATENT DOCUMENTS

CN 1112821 A 12/1995
CN 2925215 Y 7/2007

(Continued)

OTHER PUBLICATIONS

Anonymous, "Height Adjustable Sit to Stand Up Office Furniture Computer Desk", www.Alibaba.com, <https://www.alibaba.com/product-detail/Height-Adjustable-Sit-to-Stand-Up_60722049155.html?spm=a2700.7724838.2017115.134.2d974213ieYKwZ>, Accessed Jun. 7, 2019, 14 pages.

(Continued)

*Primary Examiner* — Jose V Chen
(74) *Attorney, Agent, or Firm* — Andrew D. Wright; Roberts Calderon Safran & Cole, P.C.

(57) ABSTRACT

A system includes: a case including a first part pivotally connected to a second part, wherein the first part and the second part are configurable in a first case position in which the case is closed, and the first part and the second part are configurable in a second case position in which the case is open; an adjustable stand connected to an interior of the case, the adjustable stand including: a bottom frame connected to the case; a top frame connected to the bottom frame via at least one height adjustment system; and a platform connected to the top frame. The platform is rotatable relative to the top frame such that the platform can be positioned at one of plural predefined tilt-angles relative to the top frame. The height adjustment system permits the top frame to be moved vertically relative to the bottom frame to (Continued)

position the top frame at one of plural predefined heights relative to the bottom frame.

24 Claims, 12 Drawing Sheets

(51) Int. Cl.
*A47B 13/08* (2006.01)
*A47B 9/00* (2006.01)

(56) References Cited

U.S. PATENT DOCUMENTS 2,630,639 A * 3/1953 Kmonk ..... D06F 81/00 38/139
3,000,683 A * 9/1961 MacNeary ..... A47B 21/02 312/235.3
3,055,130 A * 9/1962 Maple ..... D06F 81/00 108/33
3,082,049 A * 3/1963 Lifton ..... A45C 13/02 312/200
3,861,328 A * 1/1975 Lawless ..... A47B 19/06 108/115
4,564,091 A * 1/1986 Coneglio ..... A45C 3/02 108/102
D302,618 S * 8/1989 Gottselig ..... D34/23
5,002,293 A * 3/1991 Gottselig ..... B62B 3/02 108/145
5,379,893 A 1/1995 Ruiz
5,390,608 A * 2/1995 McLaren ..... A47B 23/002 108/25
5,992,155 A 11/1999 Kobayashi et al.
6,036,011 A 3/2000 DeCurtis et al.
6,439,133 B1 * 8/2002 Jaramillo ..... A47B 1/08 108/25
6,454,064 B1 * 9/2002 Cheng ..... A45C 9/00 190/11
7,207,438 B2 * 4/2007 Lieffring ..... B25H 3/06 108/143
7,278,644 B2 * 10/2007 Villarreal ..... A47B 3/10 190/12 A
7,740,312 B2 * 6/2010 Johnson, Jr. ..... A47B 13/16 297/217.6
7,950,338 B2 * 5/2011 Smed ..... A47B 9/16 108/119
8,616,354 B2 * 12/2013 Azirian ..... A47B 3/10 190/1
8,881,659 B2 * 11/2014 Ackeret ..... B60N 3/002 108/44
8,991,319 B2 * 3/2015 Korpi ..... A47B 23/001 108/25
9,492,904 B1 * 11/2016 Dunn ..... B23Q 3/18
2004/0134813 A1 7/2004 Domotor
2011/0011759 A1 1/2011 Luo
2013/0145972 A1 * 6/2013 Knox ..... B60N 3/063 108/145
2014/0216873 A1 8/2014 Montes
2018/0160799 A1 6/2018 Westergard et al.

FOREIGN PATENT DOCUMENTS

CN 101507549 A 8/2009
CN 201468295 U 5/2010
CN 102805484 A 12/2012
CN 202566960 U 12/2012
CN 203801976 U 9/2014
CN 203913736 U 11/2014
CN 204427111 U 7/2015
CN 106308066 A 1/2017
CN 107300110 A 10/2017
DE 102006024345 B3 12/2007
DE 202008000403 U1 3/2008
ES 1068476 Y 1/2009
KR 101707110 B1 2/2017
KR 101827676 B1 2/2018
WO 2018010262 A1 1/2018
WO 2018023337 A1 2/2018

OTHER PUBLICATIONS

Anonymous, "Alibaba best selling sit and stand height adjustable desk(JN-BJ03)" , www.Alibaba.com, <https://www.alibaba.com/product-detail/alibaba-best-selling-sit-and-stand_60747848586.html? spm=a2700.7724838.2017115.548.2d974213ieYKwZ>, Accessed Jun. 7, 2019, 5 pages.
Anonymous, "Compact Standing Desk Converter", www.Amazon.com, <https://www.amazon.com/Standing-Converter-Adjustable-assembly-required/dp/B07BHF7LJJ/ref=sr_1_233?ie=UTF8&qid=1530689871&sr=8-233&keywords=laptop+stand+height+adjustable>, Accessed Jun. 7, 2019, 8 pages.
Anonymous, "Soges X-Shaped Standing Desk Height Adjustable Desk Converter", www.Amazon.com <https://www.amazon.co.uk/X-shaped-Standing-Height-Adjustable-Converter/dp/B074NN6785>, Accessed Jun. 7, 2019, 4 pages.
Anonymous, "MOBICASE", Kickstarter, , accessed Jun. 7, 2019, <https://www.kickstarter.com/projects/361894314/mobicase-minimalist-laptop-bag-with-ergonomic-stan>, 41 pages.

* cited by examiner

ADJUSTABLE HEIGHT STAND AND CASE

FIELD OF THE INVENTION

The present invention relates generally to work surfaces and, more particularly, to an adjustable height stand and case.

BACKGROUND

Desk stands are used to provide a work surface at a height above an existing surface, such as a desk or table. The work surface may be used, for example, to support a computer keyboard or a laptop computer. In this manner, a user may stand at the desk while using their keyboard/laptop that is supported by the desk stand at a height above the desk. Some desk stands are adjustable so that the height of the work surface above the desk may be varied.

SUMMARY

In a first aspect of the invention, there is a system comprising: a case comprising a first part pivotally connected to a second part, wherein the first part and the second part are configurable in a first case position in which the case is closed, and the first part and the second part are configurable in a second case position in which the case is open; an adjustable stand connected to an interior of the case, the adjustable stand comprising: a bottom frame connected to the case; a top frame connected to the bottom frame via at least one height adjustment system; and a platform connected to the top frame. The platform is rotatable relative to the top frame such that the platform can be positioned at one of plural predefined tilt-angles relative to the top frame. The height adjustment system permits the top frame to be moved vertically relative to the bottom frame to position the top frame at one of plural predefined heights relative to the bottom frame.

In embodiments, the bottom frame is connected to the case by connectors that permit the stand to be selectively connected to, and disconnected from, the case. The case may comprise one of a briefcase and a bag. In implementations, the system is structured and arranged such that: the stand is collapsible to a first stand position in which the stand fits completely inside the case when the case is closed; and the stand is moveable from the first stand position to a second stand position in which the stand extends upward out of the case when the case is open.

In further embodiments, the height adjustment system comprises at least one scissor mechanism that is operatively connected between the bottom frame and the top frame. The system may further comprise a locking mechanism that selectively locks the at least one scissor mechanism at one of plural predefined positions, wherein respective ones of the plural predefined positions correspond to respective ones of the plural predefined heights. In implementations, the locking mechanism comprises an element that, when actuated by a user, unlocks the locking mechanism and permits lowering the top frame relative to the bottom frame.

In still further embodiments, the system comprises: an auxiliary platform; and an attachment system connected to the stand, wherein the attachment system permits the auxiliary platform to be selectively connected to, and disconnected from, the stand. In some implementations, the system is configured such that: a top surface of the auxiliary platform is in a substantially horizontal orientation when the auxiliary platform is connected to the stand via the attachment system; the top surface of the auxiliary platform remains in a substantially horizontal orientation when the top frame is moved vertically relative to the bottom frame; and the top surface of the auxiliary platform remains in a substantially horizontal orientation when the platform is rotated relative to the top frame.

In even further embodiments, the system includes: a platform support pivotally connected to the platform; and plural stops on the top frame. In this embodiment the system is configured such that: the platform support engages a first one of the plural stops when the platform is at a first one of the plural predefined tilt-angles; the platform support engages a second one of the plural stops when the platform is at a second one of the plural predefined tilt-angles; and the platform support does not engage any of the plural stops when the platform is at a third one of the plural predefined tilt-angles.

In another aspect of the invention, there is a system comprising: an adjustable stand configured to be connected to an interior of a case, the adjustable stand comprising: a bottom frame; a top frame connected to the bottom frame via at least one height adjustment system; and a platform connected to the top frame; and plural connectors configured to be connected to an interior of the case. The plural connectors, when connected to the case, are configured to selectively receive and retain the bottom frame of the stand, such that the connectors are structured and arranged to selectively connect the stand to, and disconnect the stand from, the case. The platform is rotatable relative to the top frame such that the platform can be positioned at one of plural predefined tilt-angles relative to the top frame. The height adjustment system permits the top frame to be moved vertically relative to the bottom frame to position the top frame at one of plural predefined heights relative to the bottom frame.

In another aspect of the invention, there is a system comprising: an adjustable stand comprising: a bottom frame; a top frame connected to the bottom frame via at least one height adjustment system; and a platform connected to the top frame; an auxiliary platform; and an attachment system connected to the stand. The attachment system permits the auxiliary platform to be selectively connected to, and disconnected from, the stand. The platform is rotatable relative to the top frame such that the platform can be positioned at one of plural predefined tilt-angles relative to the top frame. The height adjustment system permits the top frame to be moved vertically relative to the bottom frame to position the top frame at one of plural predefined heights relative to the bottom frame. The system is configured such that: a top surface of the auxiliary platform is in a substantially horizontal orientation when the auxiliary platform is connected to the stand via the attachment system; the top surface of the auxiliary platform remains in a substantially horizontal orientation when the top frame is moved vertically relative to the bottom frame; and the top surface of the auxiliary platform remains in a substantially horizontal orientation when the platform is rotated relative to the top frame.

BRIEF DESCRIPTION OF THE SEVERAL VIEWS OF THE DRAWINGS

The present invention is described in the detailed description which follows, in reference to the noted plurality of drawings by way of non-limiting examples of exemplary embodiments of the present invention.

DETAILED DESCRIPTION

Figure 1:
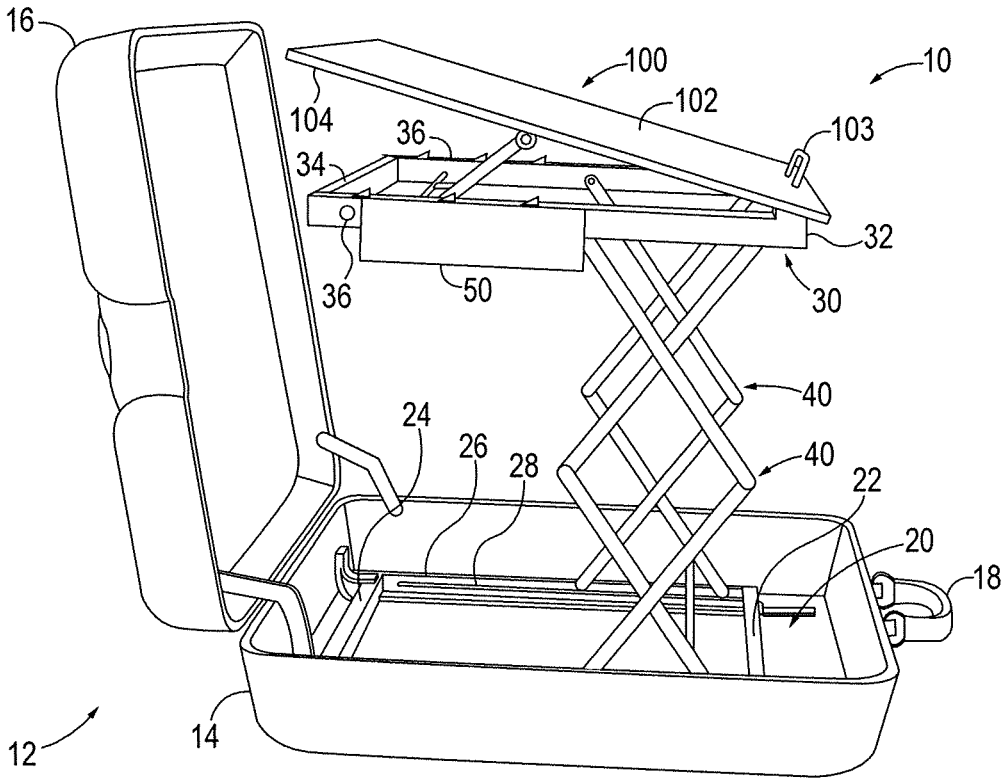
FIGS. 1 and 2 show different views of an adjustable height stand and case in accordance with aspects of the invention.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The present invention relates generally to work surfaces and, more particularly, to an adjustable height stand and case. According to aspects of the invention, an adjustable height stand is selectively connected to the interior of a case. The adjustable height stand is sized to fit inside the case when the adjustable height stand is collapsed to its lowest position. In this manner, the adjustable height stand is configured to be carried in the case while the case is closed, and is configured to be selectively adjusted to different heights when the case is open. In a particular exemplary embodiment, the adjustable height stand is sized to fit inside the case with a laptop computer when the case is closed. In this manner, a user may utilize the case to carry their laptop computer to a location, place the case on a desk or table at the location, open the case, and raise the adjustable height stand, which is supporting the laptop computer, to a height above the desk.

According to aspects of the invention, the adjustable height stand includes a platform that includes a work surface. The work surface may be substantially flat and may be used to support an object such as, for example, a computer keyboard, laptop computer, tablet computer, calculator, pad of paper, etc. In embodiments, the platform is pivotally connected to a frame of the adjustable height stand, such that the platform may be selectively tilted relative to a horizontal plane. In this manner, an object supported on the work surface may be tilted to a location that is most comfortable for the user to interact with the object.

According to aspects of the invention, the adjustable height stand includes an auxiliary platform in addition to the platform that includes the work surface. The auxiliary platform may have a substantially flat upper surface that is configured to be used as a mouse pad. In embodiments, the auxiliary platform is selectively attachable to and detachable from the frame of the adjustable height stand. In this manner, the auxiliary platform may be carried in the closed case with the collapsed adjustable height stand, and may be attached to the adjustable height stand when the case is opened and the platform of the adjustable height stand is raised up out of the case. In embodiments, the auxiliary platform remains static in its position relative to the frame when the platform is tilted relative to the frame. In embodiments, a user may place their laptop on the platform and a mouse device that communicates with the laptop on the auxiliary platform, and the auxiliary platform holding the mouse device remains substantially horizontal when the platform holding the laptop is tilted relative to horizontal. In this manner, the mouse device is supported on a substantially horizontal plane even when the laptop is tilted relative to the horizontal plane. If the auxiliary platform acting as a mouse pad were to tilt with the platform holding the laptop, then the mouse device would be at risk of sliding off the auxiliary platform when the platform holding the laptop is tilted, and implementations of the invention advantageously avoid this undesired situation.

Figure 2:
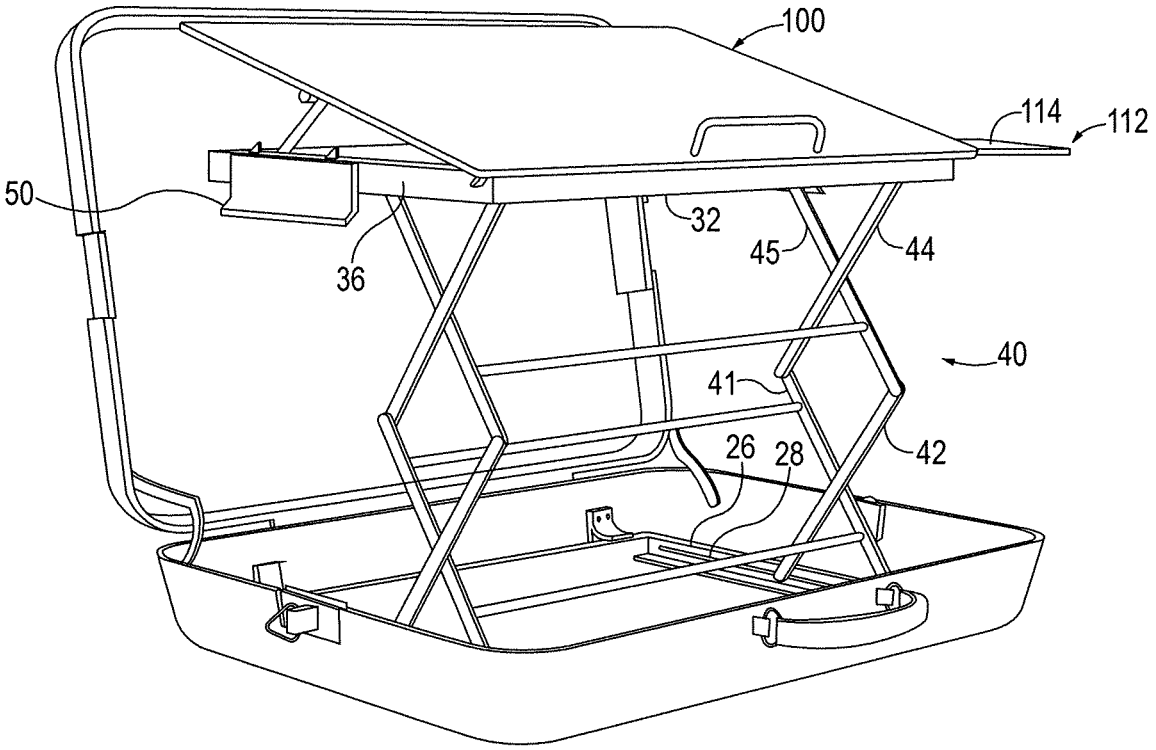

FIGS. 1 and 2 show different views of an adjustable height stand 10 and case 12 in accordance with aspects of the invention. In embodiments, the case 12 includes a case bottom 14 pivotally attached to a case top 16 such that the case 12 may open and close in a conventional manner, e.g., like a briefcase or suitcase. In this manner, the case 12 comprises a first part pivotally connected to a second part, wherein the first part and the second part are configurable in a first case position in which the case is closed, and the first part and the second part are configurable in a second case position in which the case is open. The case 12 may include one or more conventional features including but not limited to: one or more handles 18; one or more interior pockets; one or more exterior pockets; and one or more latches or locks for securing the case bottom 14 and the case top 16 in a closed position.

As shown in the figures, the adjustable height stand 10 includes a bottom frame 20, a top frame 30, and at least height adjustment system connected between the bottom frame 20 and the top frame 30. In embodiments the height adjustment system comprises at least one scissor mechanism, although aspects of the invention are not limited to this particular height adjustment mechanism. In a preferred embodiment, there are two scissor mechanisms 40 between the bottom frame 20 and the top frame 30. Each scissor mechanism 40 includes plural linked, foldable supports arranged in a crisscross "X" pattern that permits the top frame 30 to be moved vertically relative to the bottom frame 20.

According to aspects of the invention, the adjustable height stand 10 includes a platform 100 pivotally connected to the top frame 30. The platform 100 includes a top surface 102 and a bottom surface 104. In embodiments, the top surface 102 is configured for use as a work surface, and may be used to support various items including but not limited to: a computer keyboard, laptop computer, tablet computer, calculator, pad of paper, etc. In a particular embodiment, the top surface 102 is substantially flat and includes at least one protuberance 103 near its front edge. In accordance with aspects of the invention, the at least one protuberance 103 is configured to prevent an item resting on the top surface 102 from slipping off the front edge of the platform 100, in particular when the platform 100 is tilted relative to the top frame 30. As described herein, the platform 100 is rotatable relative to the top frame 30 such that the platform 100 can be positioned at one of plural predefined tilt-angles relative to the top frame 30.

With continued reference to FIGS. 1-2, in accordance with aspects of the invention, the bottom frame 20 includes a bottom front rail 22, bottom rear rail 24, and bottom side rails 26 that are connected together in a rectangular shape that is oriented horizontally. Similarly, the top frame 30 includes a top front rail 32, top rear rail 34, and top side rails 36 that are connected together in a rectangular shape that is oriented horizontally. Each of the bottom side rails 26 has a groove 28 on its inner side in which an element connected to the scissor mechanisms 40 travels when the top frame 30 is moved vertically relative to the bottom frame 20. Similarly, each of the top side rails 36 has a groove 38 on its inner side in which an element connected to the scissor mechanisms 40 travels when the top frame 30 is moved vertically relative to the bottom frame 20.

In embodiments, each scissor mechanism 40 comprises four links that are arranged in a stacked, double-X configuration. For example, as shown in the figures, an embodiment of the scissor mechanism 40 comprises links 41 and 42 that are pivotally connected (e.g., by a pin or axle), and links 44 and 45 that are pivotally connected. A top end of link 41 is pivotally connected to a bottom end of link 44, and a top end of link 42 is pivotally connected to a bottom end of link 45. In accordance with aspects of the invention, a bottom end of link 41 is pivotally connected (e.g., by a pin or axle) to one of the bottom side rails 26 in a manner such that the link 41 may rotate relative to the bottom side rail 26 but cannot translate relative to the bottom side rail 26. Similarly, a top end of link 44 is pivotally connected (e.g., by a pin or axle) to one of the top side rails 36 in a manner such that the link 44 may rotate relative to the top side rail 36 but cannot translate relative to the top side rail 36.

According to aspects of the invention, the bottom end of link 42 is connected to the same bottom side rail 26 as is the bottom end of link 41, and is connected in a manner such that the link 42 may rotate relative to the bottom side rail 26 and may translate relative to the bottom side rail 26 in the groove 28 defined by the bottom side rail 26. Similarly, the top end of link 45 is connected to the same to the top side rail 36 as is the top end of link 44, and is connected in a manner such that the link 45 may rotate relative to the top side rail 36 and may translate relative to the top side rail 36 in the groove 38 defined by the top side rail 36.

In embodiments, the link 42 comprises a pin that extends perpendicularly (e.g., horizontally) from the bottom end of the link 42, the pin being arranged inside the groove 28 in the bottom side rail 26. A roller, bushing, slide, bearing or the like is arranged on the pin, and at least partially in the groove 28, to facilitate smooth translational and rotational movement of the bottom end of the link 42 relative to the bottom side rail 26. For example, the pin may have an outside diameter that is smaller than the vertical dimension of the opening of the groove 28, such that the pin extends from the bottom end of the link 42 and through the groove 28 into a hollow interior of the bottom side rail 26. In this example, a plastic slide is arranged on the end of the pin, the slide being inside the hollow interior of the bottom side rail 26 and having a dimension that is larger than the vertical dimension of the opening of the groove 28, such that the pin is maintained in the groove. A similar connection may be used for the top end of the link 45 in the groove 38 of the top side rail 36.

Although only one scissor mechanism 40 has been described, in embodiments both scissor mechanisms 40 may be arranged in a similar manner as described herein, albeit on opposite sides of the bottom frame 20 and the top frame 30. In this manner, a first scissor mechanism 40 is connected between the bottom side rail 26 and the top side rail 36 at a left side of the bottom frame 20 and the top frame 30, and a second scissor mechanism 40 is connected between the bottom side rail 26 and the top side rail 36 at a right side of the bottom frame 20 and the top frame 30.

In accordance with aspects of the invention, and as described herein, the scissor mechanisms 40 permit vertical movement of the top frame 30 relative to the bottom frame 20 while the top frame 30 and the bottom frame 20 each remain horizontal during the vertical movement. When the top frame 30 moves upward (e.g., away from the bottom frame 20), the bottom end of link 41 stays at fixed location relative to the bottom frame 20, and the bottom end of link 42 translates in direction D1 toward the bottom end of the link 41, the translation being along the groove 28 in the bottom side rail 26. Similarly, when the top frame 30 moves upward (e.g., away from the bottom frame 20), the top end of link 44 stays at fixed location relative to the top frame 30, and the top end of link 45 translates in direction D1 toward the top end of the link 44, the translation being along the groove 38 in the top side rail 36. Conversely, when the top frame 30 moves downward (e.g., toward the bottom frame 20), the bottom end of link 41 stays at fixed location relative to the bottom frame 20, and the bottom end of link 42 translates in direction D2 away from the bottom end of the link 41, the translation being along the groove 28 in the bottom side rail 26. Similarly, when the top frame 30 moves downward (e.g., toward the bottom frame 20), the top end of link 44 stays at fixed location relative to the top frame 30, and the top end of link 45 translates in direction D2 away from the top end of the link 44, the translation being along the groove 38 in the top side rail 36.

In a particular embodiment, when the bottom frame 20 is connected to the case bottom 14, the scissor mechanisms 40 permit vertical movement of the top frame 30 relative to the case bottom 14, with the top frame remaining horizontal during this vertical movement. In this manner, the top frame 30 may be selectively raised and lowered relative to the case bottom 14.

According to aspects of the invention, the adjustable height stand 10 includes a locking mechanism that is configured to selectively lock the height of the top frame 30 relative to the bottom frame 20. In embodiments, the locking mechanism locks the height of the top frame 30 at one of a number of predefined locations above a fully collapsed position.

Figure 3A:
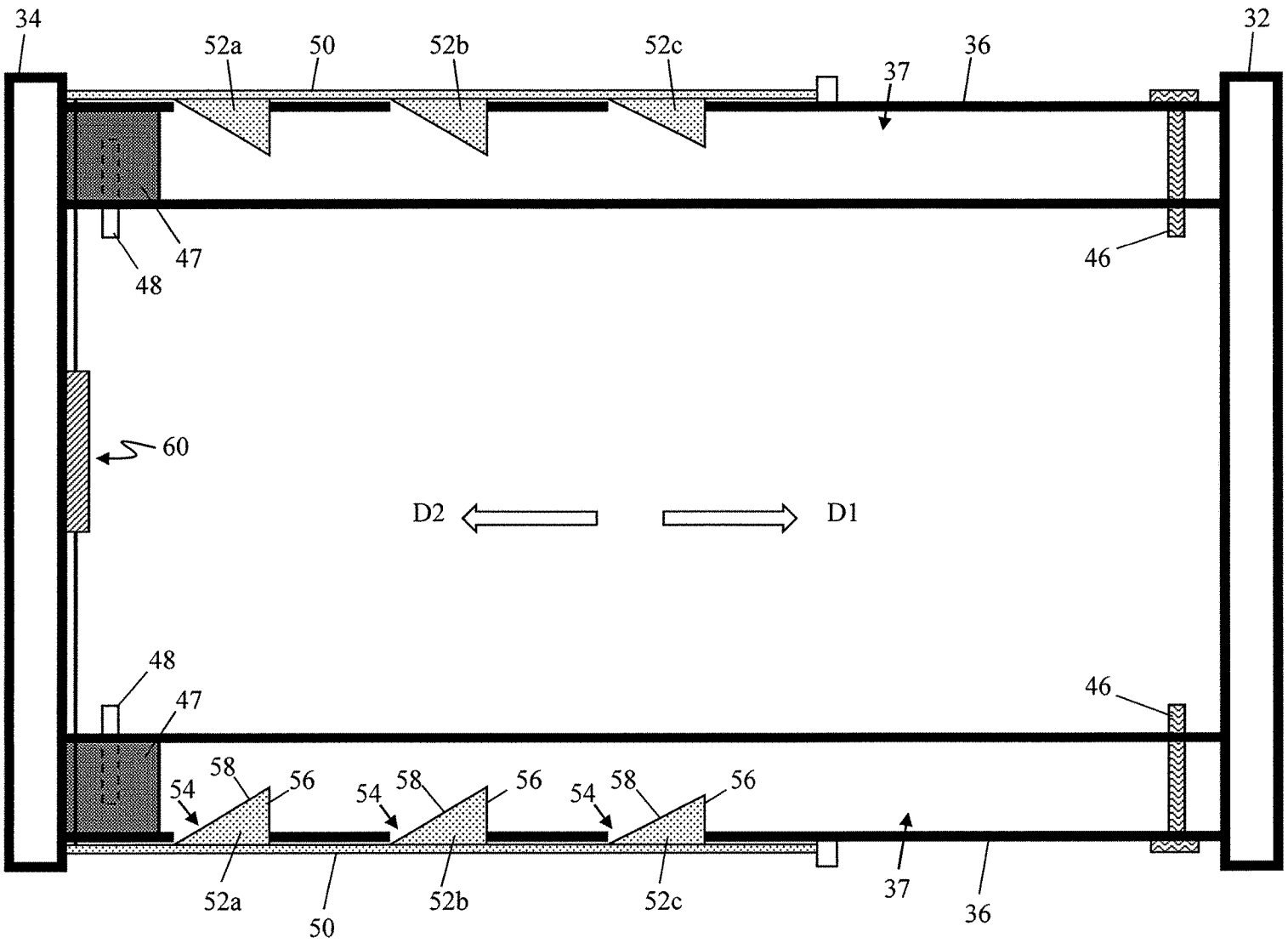
FIGS. 3A, 3B, and 3C illustrate a locking mechanism in accordance with aspects of the invention.
Figure 3B:
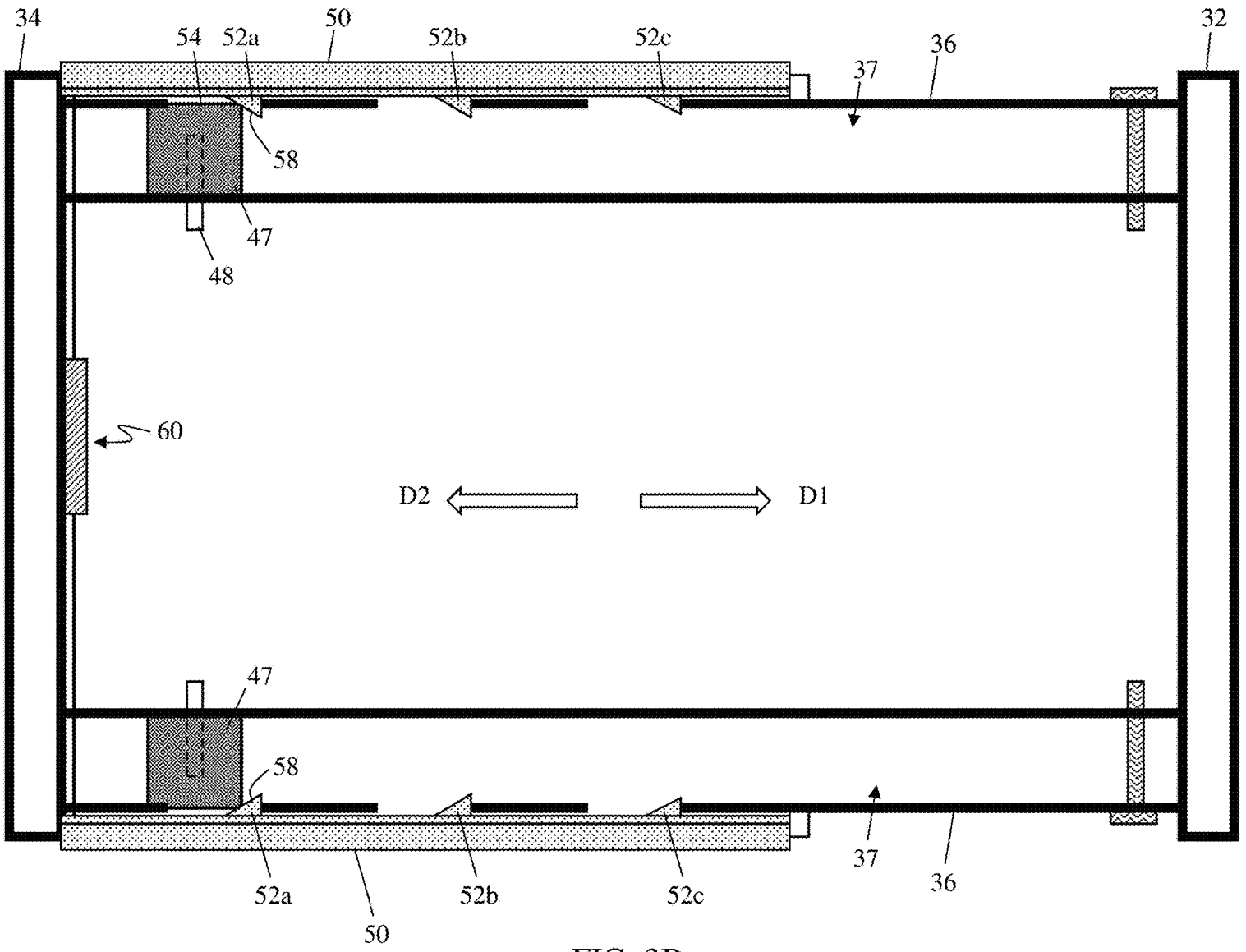
Figure 3C:
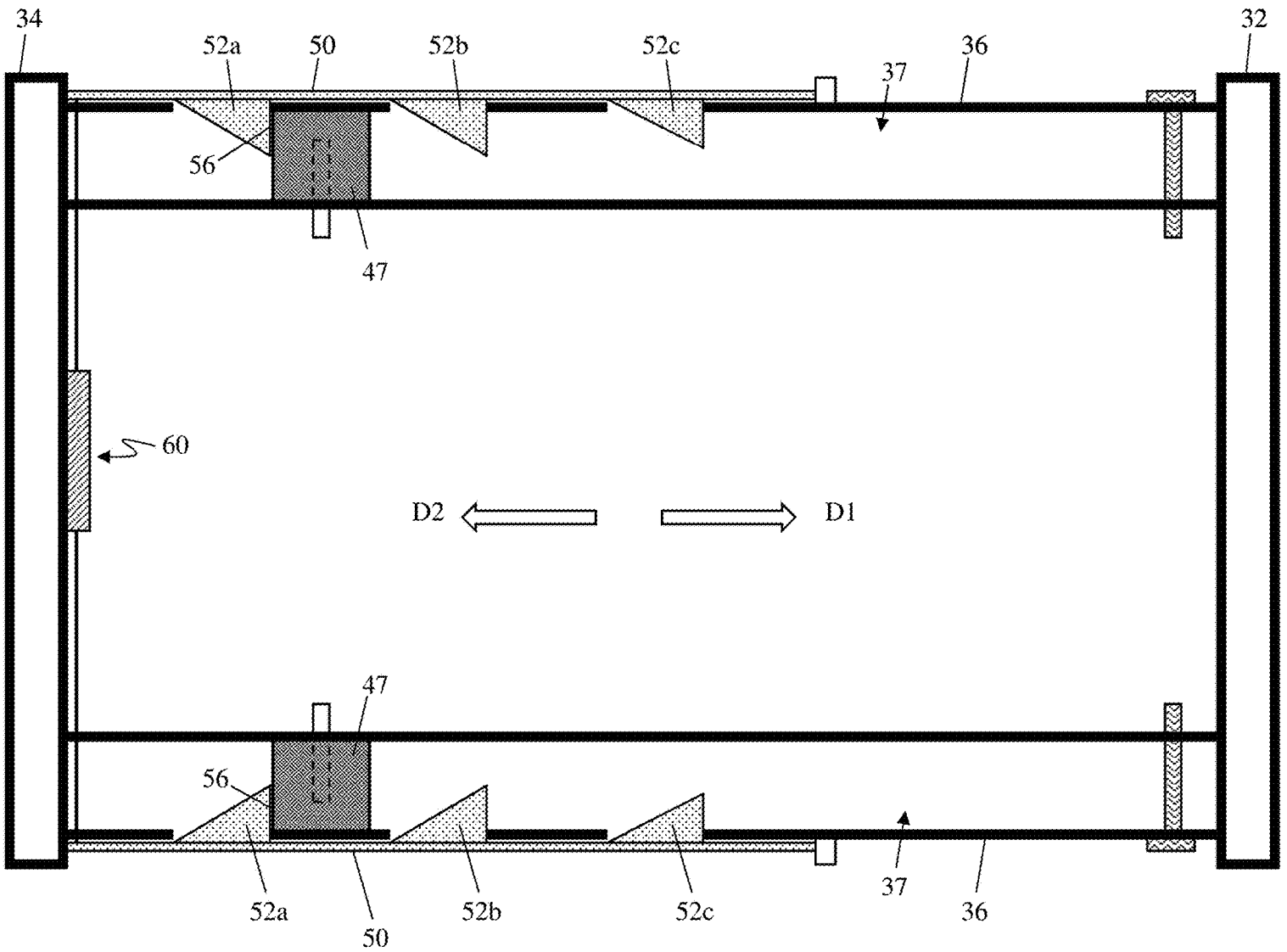

FIGS. 3A, 3B, and 3C illustrate a locking mechanism in accordance with aspects of the invention. In particular, FIGS. 3A-C each show a plan (i.e., top-down) cutaway view of the top frame 30 and related elements. As shown in FIG. 3A, the two top side rails 36 are connected to the top front rail 32 and the top rear rail 34. Each of the top side rails 36 has a hollow interior 37. At each of the top side rails 36, the top end of link 44 is connected via pivotal attachment element 46, which may comprise a bolt, screw, or similar element that permits the top end of link 44 to rotate relative to the top side rail 36 but that prevents translational movement of the top end of link 44 to rotate relative to the top side rail 36. Inside each of the hollow interiors 37 is a slide 47 connected to a pin 48 that extends through the groove at the inner side of the top side rail 36 and connects to the top of link 45. As described herein, the slide 47 translates inside the top side rail 36 in direction D1 when raising the height of top frame 30, and in direction D2 when lowering the height of top frame 30.

In embodiments, the locking mechanism comprises respective handles 50, each of which is pivotally attached to an outer side of one of the top side rails 36. Each handle 50 includes a number of protrusions 52*a-c* extending inward from an inner side surface of the handle. The number of protrusions 52*a-c* defines the number different heights that the top frame 30 can be locked at relative to the bottom frame 20. In embodiments, an outside surface of the top side rail 36 (i.e., opposite the inner side surface that contains the groove 38), has a number of holes 54 corresponding to the number of protrusions 52*a-c* on the handle 50, with each one of the protrusions 52*a-c* extending through one of the holes 54 and into the hollow interior of the top side rail 36 when the handle 50 is in a first position relative to the top side rail 36.

In accordance with aspects of the invention, each protrusion 52*a-c* is configured to prevent translational movement of the slide 47 in direction D2 when the handle 50 is in the first position. In embodiments, each protrusion 52*a-c* has a flat side 56 and sloped side 58 arranged such that the slide 47 will contact the flat side 56 when the slide 47 is moving in direction D2 and will contact the sloped side 58 when moving in direction D1. The handles 50 are connected to one another by a resilient element 60 that simultaneously urges each of the handles 50 to the first position. The resilient element 60 may comprise a spring that exerts a biasing force on each of the handles 50 that pulls the handles 50 toward one another.

Figure 5:
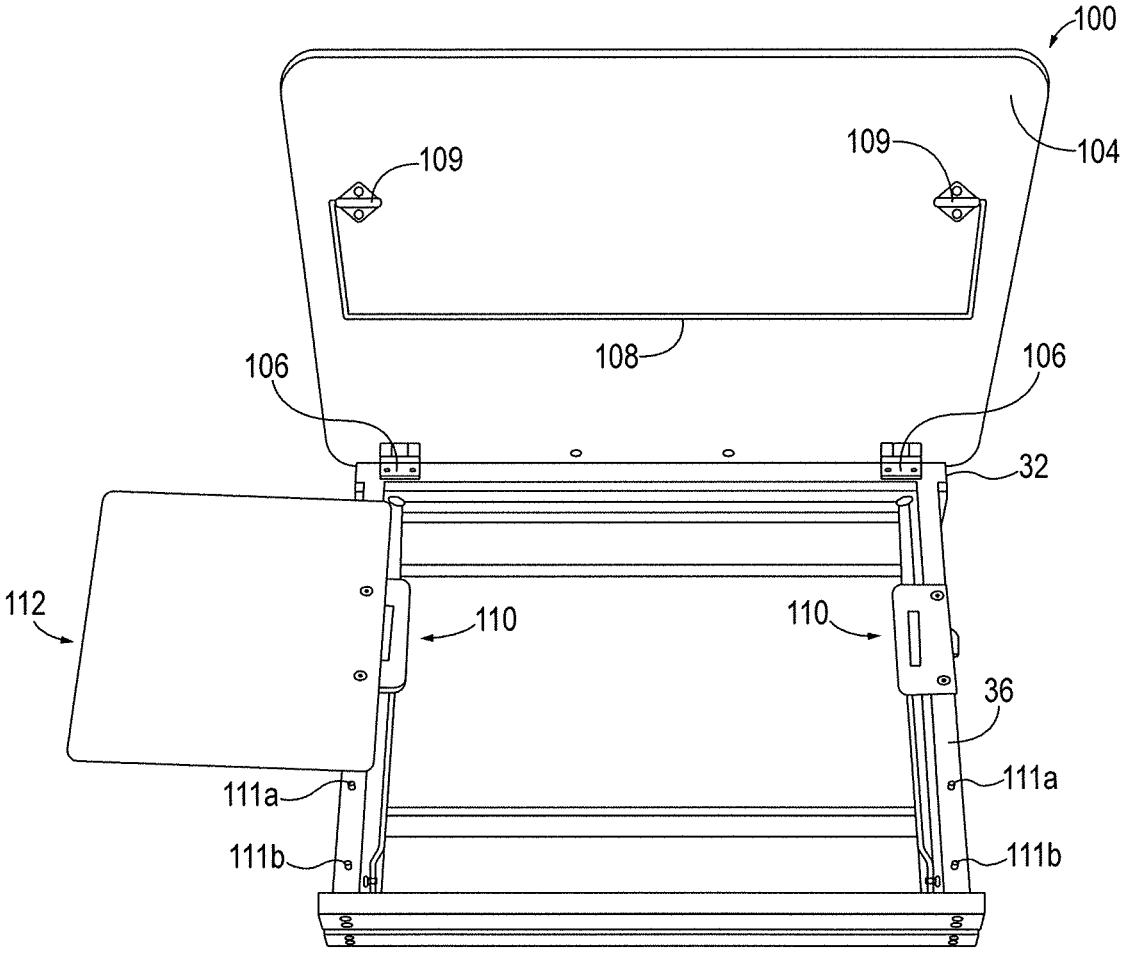
FIG. 5 shows a view of the adjustable height stand in accordance with aspects of the invention.
Figure 6:
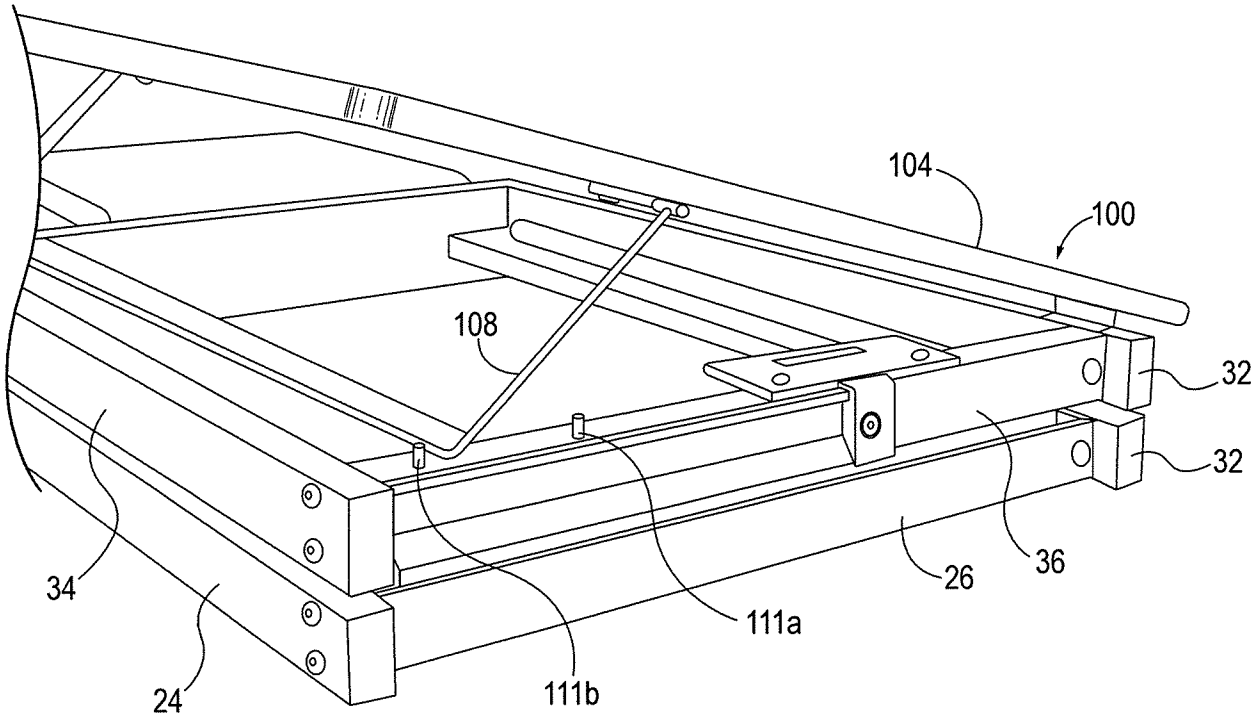
FIG. 6 shows a view of the adjustable height stand in accordance with aspects of the invention.

FIG. 3A shows the slides 47 at a position corresponding to the fully collapsed position of the adjustable height stand 10. (For reference, the fully collapsed position is also shown in FIGS. 5 and 6.) According to aspects of the invention, to raise the top frame 30 from the fully collapsed position to another height, a user grasps the two top side rails 36 and pulls upward, which causes the top frame 30 to move upward away from the bottom frame 20, which causes the slides 47 to move translationally in direction D1. As shown in FIG. 3B, as the slides 47 come into contact with the sloped sides 58 of the first protrusion 52*a*, the slides 47 exert a force against the handles 50 that overcomes the resilient element 60 and causes each of the handles 50 to pivot outward relative to the respective top side rails 36. This outward pivoting of the handles 50 moves the handles 50 away from their first position, and pulls the protrusions 52*a-c* outward through the holes 54 such that the slides 47 effectively push their way past the first protrusion 52*a*. After the slides 47 move completely past the first protrusions 52*a* in direction D1, the slides 47 are no longer exerting a force on the first protrusions 52*a*, and the resilient element 60 pulls the handles 50 back to the first position in which the protrusions 52*a-c* extend through the holes 54.

FIG. 3C shows the same view as that of FIGS. 3A and 3B, after the slides 47 are moved past the first protrusions 52*a*. As shown in FIG. 3C, the slides 47 abut the flat sides 56 of the first protrusions 52*a*, thus preventing the slides from moving in direction D2 (i.e., preventing the top frame 30 from lowering toward the bottom frame 20). As such, the first protrusions 52*a* define a first raised height of the top frame 30 relative to the bottom frame 20. The user may continue to pull upward on the top frame 30, thereby moving the slides 47 past the second protrusions 52*b*, which define a second raised height of the top frame 30 relative to the bottom frame 20. The user may continue to pull upward on the top frame 30, thereby moving the slides 47 past the third protrusions 52*c*, which define a third raised height of the top frame 30 relative to the bottom frame 20. In embodiments, each handle 50 has three protrusions 52*a-c* that define three raised heights of the top frame 30 above the fully collapsed position. However, implementations of the invention are not limited to three positions, and any desired number of protrusions 52*a-c* may be used to define a desired number of raised heights of the top frame 30 above the fully collapsed position.

Still referring to FIGS. 3A-C, according to aspects of the invention, when the user wishes to lower the height of the top frame 30 relative to the bottom frame 20, the user exerts a force on both handles 50 to overcome the resilient element 60 to simultaneously pivot the handles 50 outward from top side rails 36. Doing this pulls the protrusions 52*a-c* out of the holes 54 and permits the slides 47 to move in direction D2, thereby lowering the top frame 30 relative to the bottom frame 20. In this manner, the top frame 30 can be moved back to the fully collapsed position depicted in FIG. 3A.

FIGS. 4A, 4B, 4C, and 4D show exemplary connectors for connecting the adjustable height stand and the case in accordance. According to aspects of the invention, the system includes rear connectors 70 and front connectors 80 that are configured to secure the adjustable height stand 10 to the case 12. Although two rear connectors 70 and two front connectors 80 are shown, it is understood that any number of rear connectors 70 (e.g., one, two, three, etc.) and any number of front connectors 80 (e.g., one two, three, etc.) may be used in implementations. The number of rear connectors 70 may be the same as the number of front connectors 80. Alternatively, the number of rear connectors 70 may different than the number of front connectors 80.

In accordance with aspects of the invention, the rear connectors 70 are fixedly connected to the case 12 and are configured to receive and hold the bottom rear rail 24 such that the bottom rear rail 24 can be selectively connected to, and disconnected from, the case 12. Similarly, the front connectors 80 are fixedly connected to the case 12 and are configured to receive and hold the bottom front rail 22 such that the bottom front rail 22 can be selectively connected to, and disconnected from, the case 12. The rear connectors 70 and front connectors 80 may be connected to the case 12 in any conventional or later developed method, including but not limited to: mechanical fasteners (e.g., screws, bolts, rivets, etc.), adhesive, weld, sewing, etc. Alternatively to be connected to the case 12, the rear connectors 70 and/or the front connectors 80 may be integrally formed with the case 12, such as by forming the case 12 and the rear connectors 70 and/or the front connectors 80 together in a molding process (e.g., plastic molding).

Figure 4A:
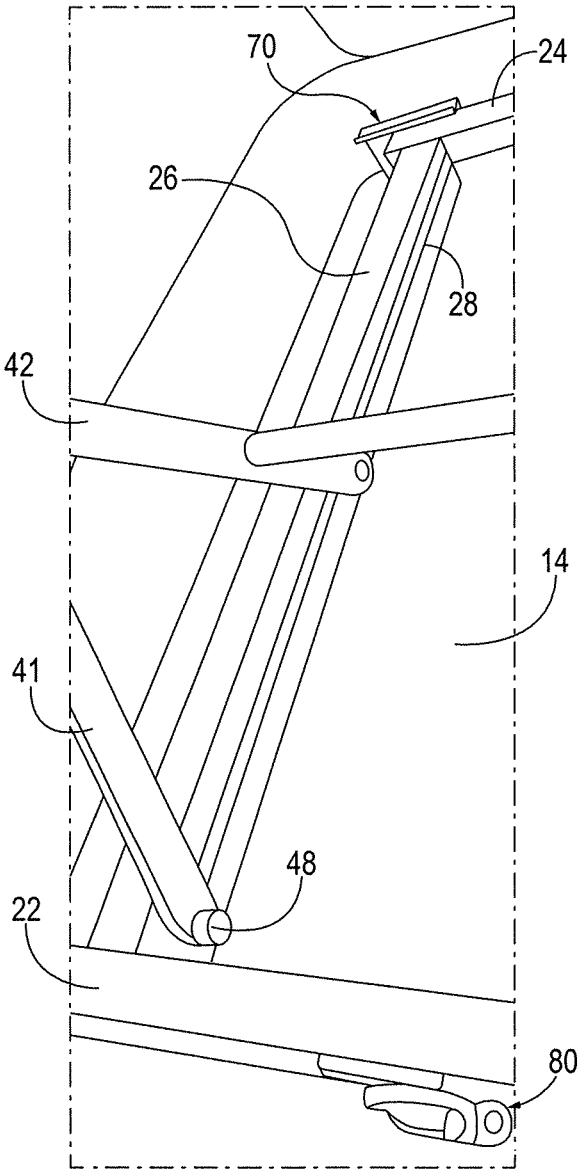
FIGS. 4A, 4B, 4C, 4D, 4E, 4F, 4G, and 4H show exemplary connectors for connecting the adjustable height stand and the case in accordance with aspects of the invention.
Figure 4B:
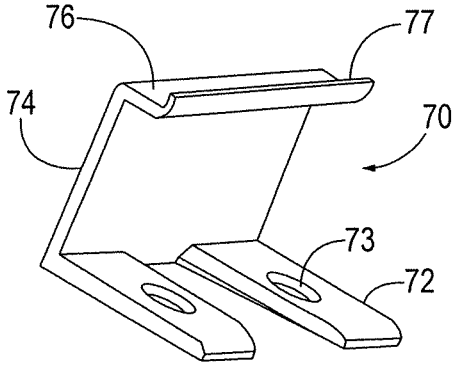

As shown in FIG. 4A, in one embodiment the rear connectors 70 are arranged in a corner of the case bottom 14. In this embodiment, the rear connectors 70 each comprise a clip comprising a base 72, a back 74, and a top 76 as illustrated in FIG. 4B. The base 72 is configured to be connected to an inner surface of a bottom wall of the case bottom 14, and may include one or more holes 73 that accommodate one or more mechanical fasteners in this regard. In embodiments, the back 74 extends between the base 70 and the top 76, and is configured to abut against an inner surface of a rear sidewall of the case bottom 14. In embodiments, the top 76 extends forward from the back 74, such that an lower surface of the top 76 and an upper surface of the base 72 face each other and define a dimension that is sized to receive and retain the bottom rear rail 24 via friction fit between the top 76 and the base 72. In embodiments, the top 76 includes a feature 77 at its front end (e.g., the end opposite the connection to the back 74), wherein the feature 77 is configured to facilitate inserting the bottom rear rail 24 into the space between the top 76 and the base 70. In one embodiment, the feature 77 comprises an upwardly curved edge as shown in FIG. 4B, although other features may be employed. The rear connectors 70 may be composed of any suitable material (or combination of materials) including but not limited to plastic, metal, etc.

Figure 4C:
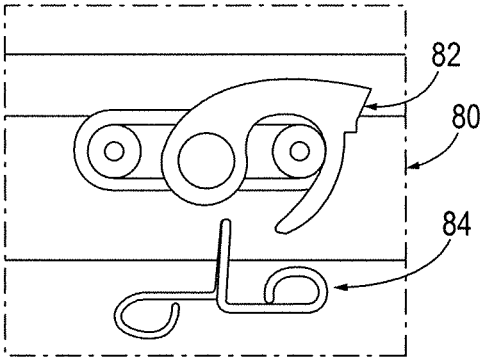
Figure 4D:
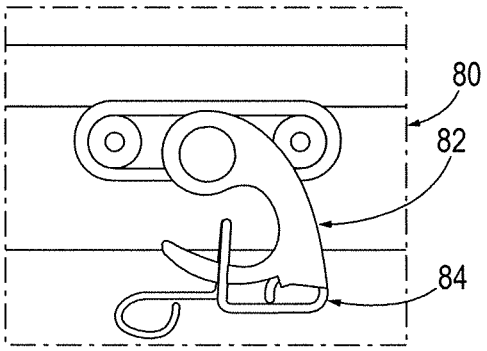

FIGS. 4C and 4D show an embodiment of the front connector 80 comprising a latch 82 and a keeper 84 that are configured to be selectively engaged to connect the bottom front rail 22 to the case bottom 14, and selectively disengaged to disconnect the bottom front rail 22 from the case bottom 14. In this embodiment, the latch 82 is connected to the bottom front rail 22 (e.g., by mechanical fastener or other suitable connection) and the keeper 84 connected to the inner surface of a bottom wall of the case bottom 14 (e.g., by mechanical fastener or other suitable connection). FIG. 4C shows the latch 82 pivoted away from and disengaged from the keeper 84, and FIG. 4D shows the latch 82 pivoted into a position in which it is engaged with the keeper 84.

In accordance with aspects of the invention, the front connectors 80 are spaced apart from the rear connectors 70 by a dimension that corresponds to a dimension between the bottom front rail 22 and the bottom rear rail 24 of the adjustable height stand 10. By spacing the front connectors 80 apart from the rear connectors 70 in this manner, the latch 82 and keeper 84 of a respective front connector 80 are aligned with one another when the bottom rear rail 24 is inserted into the rear connectors 70 and the bottom front rail 22 is placed on the interior surface of the bottom of the case 12. In this manner, a user may connect the adjustable height stand 10 to the case 12 by first sliding the bottom rear rail 24 into the rear connectors 70 and then engaging the latch 82 with the keeper 84 at each of the front connectors 80.

In the embodiment shown in FIGS. 4A, 4C, and 4D, the latch 82 comprises a hook that is pivotally connected to a base, and the keeper 84 comprises an eye that receives and holds the hook. However, implementations of the invention are not limited to this particular type of latch and keeper, and other types of latch and keeper mechanisms may be used as the front connectors 80.

In the embodiment shown in FIGS. 4A, 4C, and 4D, the latch 82 is connected to the bottom front rail 22 and the keeper 84 is connected to the inner surface of the bottom wall of the case bottom 14. However, the arrangement may be reversed such that the keeper 84 is connected to the bottom front rail 22 and the latch 82 connected to the inner surface of the bottom wall of the case bottom 14. Moreover, whichever one of the latch 82 and the keeper 84 is connected to the case 12 may be connected to any suitable surface of the case 12, including a front sidewall of the case bottom 14, for example.

Figure 4H:
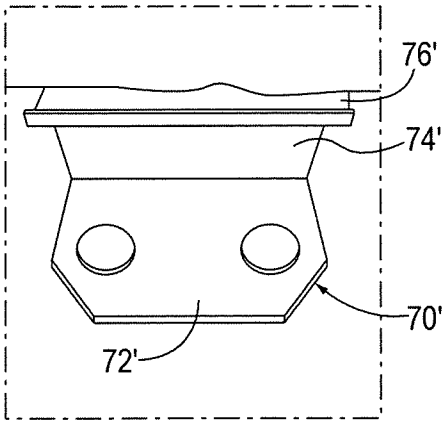
Figure 4G:
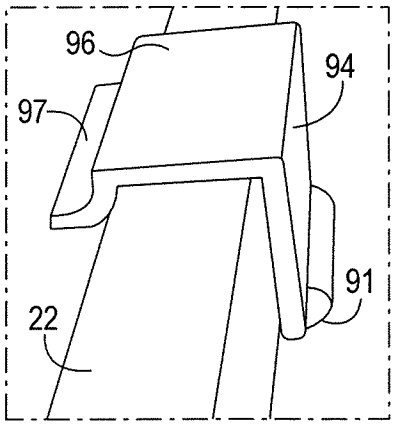
Figure 4F:
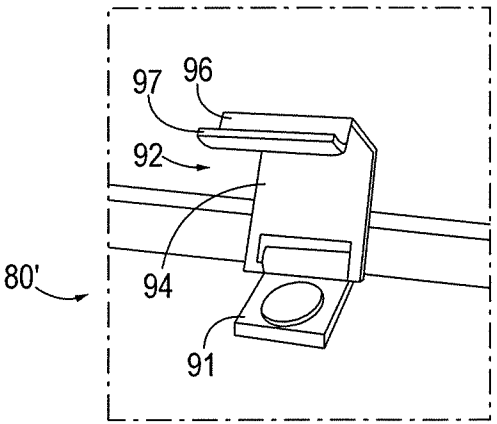
Figure 4E:
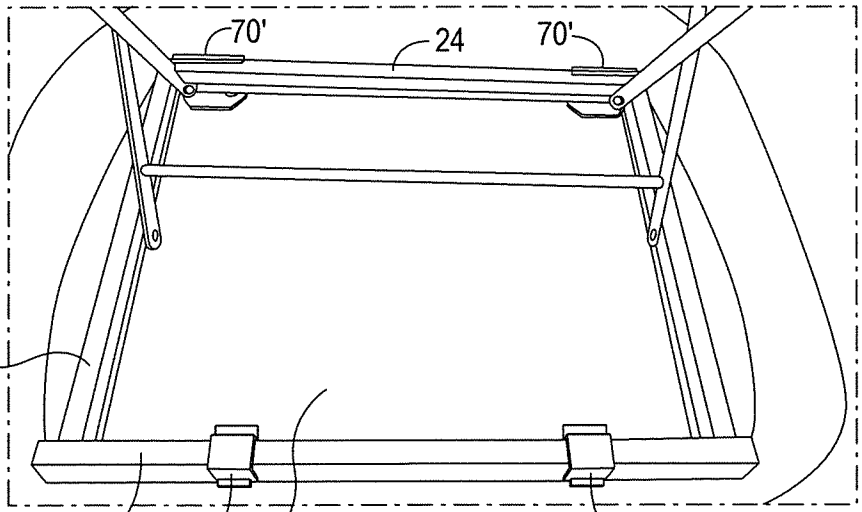

FIGS. 4E, 4F, 4G, and 4H show another embodiment of the front connector 80' and the rear connector 70' in accordance with aspects of the invention. As shown in FIG. 4E, two rear connectors 70' and two front connectors 80' are connected to the inner surface of the bottom of the case 12. As shown in FIG. 4F, in this embodiment the front connector 80' includes a base 91 and a pivoting element 92 comprising a back 94 and a top 96. In embodiments, the base 91 includes one or more holes that receive one or more mechanical fasteners that secure the base 91 to the case 12. With continued reference to FIG. 4F, in this embodiment the base 91 is pivotally connected to the pivoting element 92 by a hinged connection that permits the pivoting element 92 to rotate relative to the base 91. In this manner, the pivoting element 92 may also rotate relative the case 12 when the base 91 is securely fastened to the case 12. In embodiments, the top 96 extends outward from the back 94, and the front connector 80' is sized such that a lower surface of the top 96 and an upper surface of the base 91 face each other and define a dimension that is sized to receive and retain the bottom front rail 22 via friction fit between the top 96 and the base 91, as shown in FIG. 4G. In embodiments, the top 96 includes a feature 97 at its distal end (e.g., the end opposite the connection to the back 94), wherein the feature 97 is configured to facilitate inserting snapping the pivoting element 92 into engagement with the bottom front rail 22. In one embodiment, the feature 97 comprises an upwardly curved edge as shown in FIGS. 4F and 4G, although other features may be employed.

As shown in FIG. 4H, in this embodiment, the rear connector 70' comprises a base 72', a back 74', and a top 76' similar to those features of the rear connector 70, except that the base 72' comprises a single tongue while the base 72 comprises two tongues. The front connectors 80' and rear connectors 70' may be composed of any suitable material (or combination of materials) including but not limited to plastic, metal, etc.

In operation of the embodiment shown in FIGS. 4E-H, to connect to the adjustable height stand 10 to the case 12, a user first inserts the bottom rear rail 24 into the rear connectors 70' and, with the pivoting element 92 pivoted to an open position relative to the base 91, the use places the bottom front rail 22 on the base 91. With the bottom front rail 22 positioned on the base 91, the user then pivots the pivoting element 92 relative to the base 91, which causes the pivoting element 92 to snap into friction fit engagement with the bottom front rail 22 between the base 91 and the pivoting element 92. The adjustable height stand 10 may be disconnected from the case 12 by pivoting the pivoting element 92 back to the open position relative to the base 91, thereby unsnapping the adjustable height stand 10 from the front connector 80'.

Implementations of the invention are not limited to the two specific embodiments of front connectors 80/80' and rear connectors 70/70' shown in FIGS. 4A-H. Instead, other suitable connectors may be used that provide for selectively connecting the adjustable height stand 10 to, and disconnecting the adjustable height stand 10 from, the case 12.

FIGS. 4A-H show exemplary implementations with the rear connectors 70/70' nearer the edge of the case 12 with the hinge, and the front connectors 80/80' being further away from the edge of the case 12 with the hinge. However, the positions may be reversed, such that the front connectors 80/80' are nearer the end of the case 12 with the hinge, and the rear connectors 70/70' are further away from the edge of the case 12 with the hinge. In another implementation, all of the connectors used in the case 12 are the same type of connector. For example, four front connectors 80/80' and zero rear connectors 70/70' may be used, such that there are two front connectors 80/80' nearer the end of the case 12 with the hinge and another two front connectors 80/80' further away from the edge of the case 12 with the hinge.

FIG. 5 shows a view of the adjustable height stand in accordance with aspects of the invention. In particular, FIG. 5 shows a view from the rear and top direction, with the platform 100 tilted to a nearly vertical position. In implementations, the platform 100 is connected to the top front rail 32 by at least one hinge 106. In the embodiment shown in FIG. 5, the hinges 106 each comprise a first leaf connected to the bottom surface 104 of platform 100 (e.g., via mechanical fastener), a second leaf connected to the top front rail (e.g., via mechanical fastener), and a pin that holds the leaves together inside a knuckle. However, implementations of the invention are not limited to the particular hinge shown; instead implementations of the invention may utilize any suitable type of hinge including but not limited to: a case hinge, a butt hinge, and living hinge, etc. The at least one hinge 106 permits the platform 100 to pivot relative to the top frame 30 about an axis of rotation defined by the at least one hinge 106.

Still referring to FIG. 5, in accordance with aspects of the invention, a platform support 108 is pivotally attached to the bottom surface 104 of platform 100. In embodiments, the platform support 108 comprises a substantially "U" shaped rod that has at least one end that is pivotally connected to the bottom surface 104 of platform 100 by a fastener 109 that permits rotation of the platform support 108 relative to the platform 100. According to aspects of the invention, another portion of the platform support 108 is configured to engage stops 111*a*/111*b* on the top side rails 36. In embodiments, each of the stops 111*a*, 111*b* comprises a boss protruding from a top surface of the top side rails 36.

As shown in FIG. 6, when the platform support 108 in arranged in a position where it abuts against the stops 111*b*, the platform 100 is fixed at a first predefined angle relative to horizontal. Similarly, when the platform support 108 in arranged in a position where it abuts against the stops 111*a*, the platform 100 is fixed at a second predefined angle relative to horizontal. In this manner, by tilting the platform 100 relative to the top frame 30 and then positioning the platform support 108 against one of the sets of stops 111*a* or 111*b*, a user may selectively arrange the platform at one of plural predefined tilt angles.

In embodiments, the platform support 108 is also movable to a position behind the stops 111*b* (i.e., where it does not abut any of the stops), and at this position the platform 100 is free to pivot downward by gravity until the bottom surface 104 of the platform 100 rests on the stops 111*a*, 111*b* and the platform 100 is in a substantially horizontal position, referred to herein as the fully collapsed position. In the embodiment shown in FIGS. 5 and 6, there are thus three predefined tilt angles for the platform: a first angle when the platform is substantially horizontal (i.e., when the platform support 108 does not abut either of the stops 111*a*, 111*b*); a second angle when the platform support 108 abuts the stops 111*b*; and a third angle when the platform support 108 abuts the stops 111*a*. In this manner, the adjustable height stand 10 provides a tilt adjustment for a user who is using their laptop computer, for example, on the platform 100. Although two sets of stops 111*a*, 111*b* are shown, implementations of the invention may utilize any desired numbers of stops to define any desired number of and degree of predefined tilt angles for the platform 100.

Figure 7:
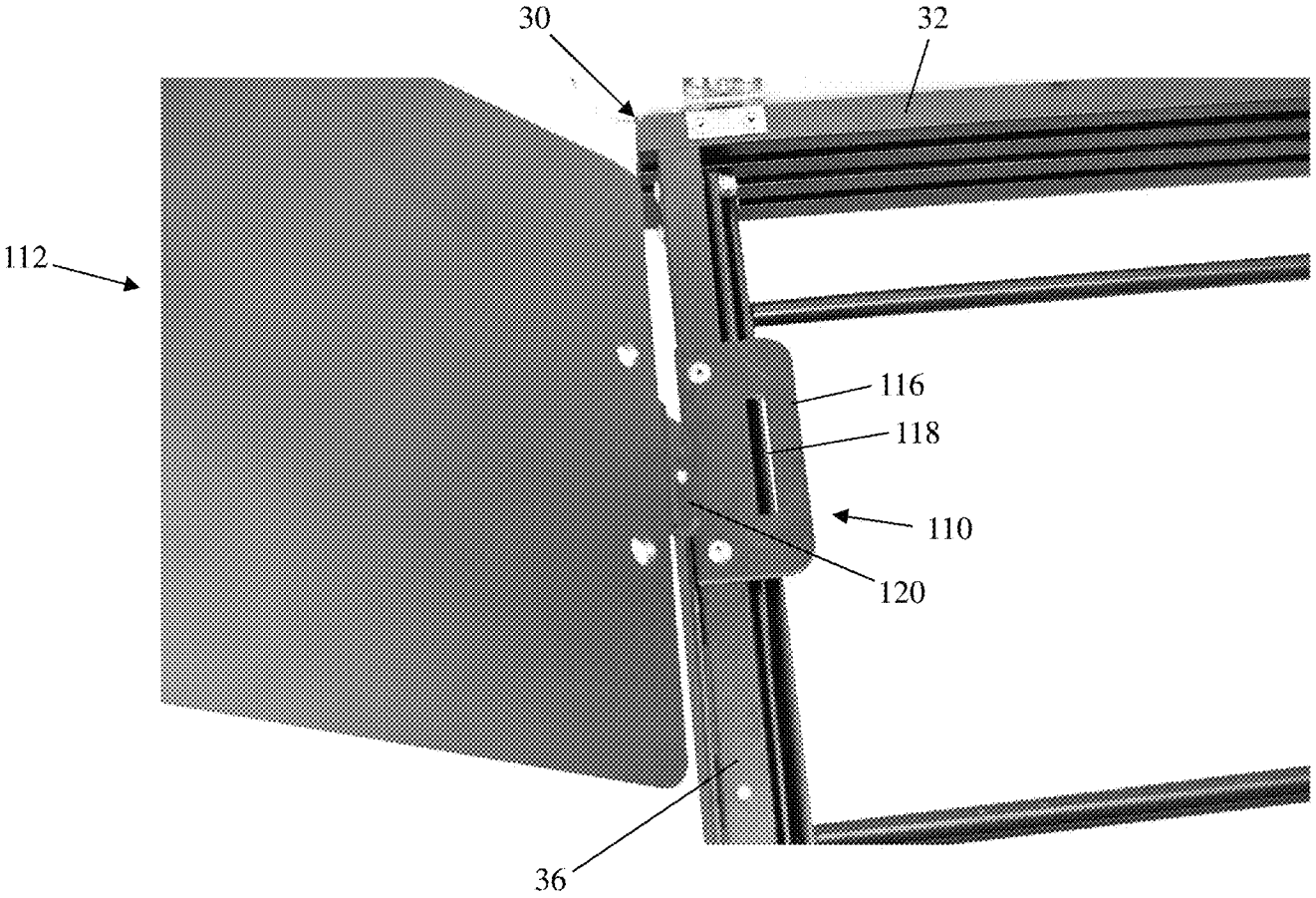
FIG. 7 shows a view of the mouse pad connector in accordance with aspects of the invention.

FIG. 7 shows a view of the mouse pad connector in accordance with aspects of the invention. In embodiments, there is an attachment system 110 connected to the top frame 30, the attachment system 110 being structured and arranged to selectively connect an auxiliary platform 112 to the top frame 30. In a preferred embodiment, the auxiliary platform 112 comprises an essentially flat top surface 114 that is usable as a mouse pad to support a mouse device that operatively communicates with a computer device (e.g., a laptop computer) that is supported by the platform 100.

Figure 8:
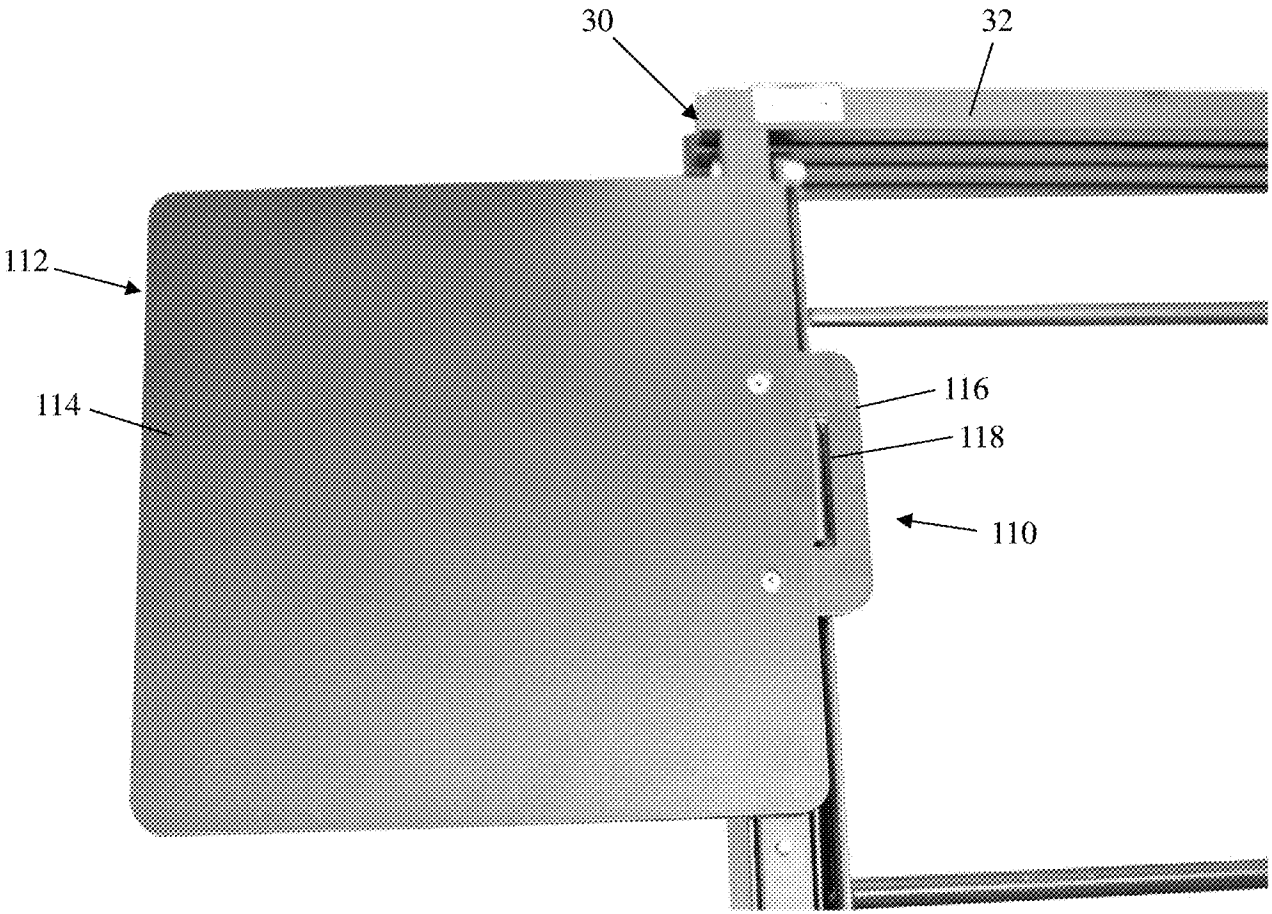
FIG. 8 shows a view of the mouse pad connector in accordance with aspects of the invention.

In the embodiment shown in FIGS. 7 and 8, the attachment system 110 comprises a bracket 116 connected to the top side rail 36. The bracket 116 comprises an aperture 118 that is structured and arranged to receive a protrusion 120 extending from the auxiliary platform 112 in a tongue-and-groove connection. FIG. 7 shows the auxiliary platform 112 disconnected from the attachment system 110, and FIG. 8 shows the auxiliary platform 112 connected to the attachment system 110. As shown in FIG. 5, there may be a respective attachment system (i.e., a respective bracket 116 in this embodiment) attached to each of the two top side rails 36. In this manner, the auxiliary platform 112 may be selectively connected to, and disconnected from, either the left side or the right side of the adjustable height stand 10 to suit the preference of the user. Implementations of the invention are not limited to the attachment system 110 comprises the bracket 116, and other attachment systems may be used to provide for selectively connecting the auxiliary platform 112 to the adjustable height stand 10.

According to aspects of the invention, the attachment system 110 and the auxiliary platform 112 are sized and shaped relative to one another such that the top surface 114 of the auxiliary platform 112 is in a substantially horizontal plane when the auxiliary platform 112 is connected to the adjustable height stand 10 via the attachment system 110. Moreover, since the auxiliary platform 112 is connected to the top frame 30 via the attachment system 110, the auxiliary platform 112 raises and lowers with the top frame 30 when the top frame 30 is raised and/or lowered relative to the bottom frame 20. Furthermore, the top surface 114 of the auxiliary platform 112 remains in a substantially horizontal orientation when the auxiliary platform 112 is raised and lowered with the top frame 30 relative to the bottom frame 20. Even further, since the auxiliary platform 112 is connected to the top frame 30 (and is not connected to the platform 100), the top surface 114 of the auxiliary platform 112 remains in a substantially horizontal orientation when the platform 100 is tilted relative to the top frame 36. In this manner, the tilt angle of the platform 100 may be adjusted (e.g., as described with respect to FIGS. 5 and 6), while the auxiliary platform 112 remains at a constant tilt angle (e.g., horizontal).

Figure 9:
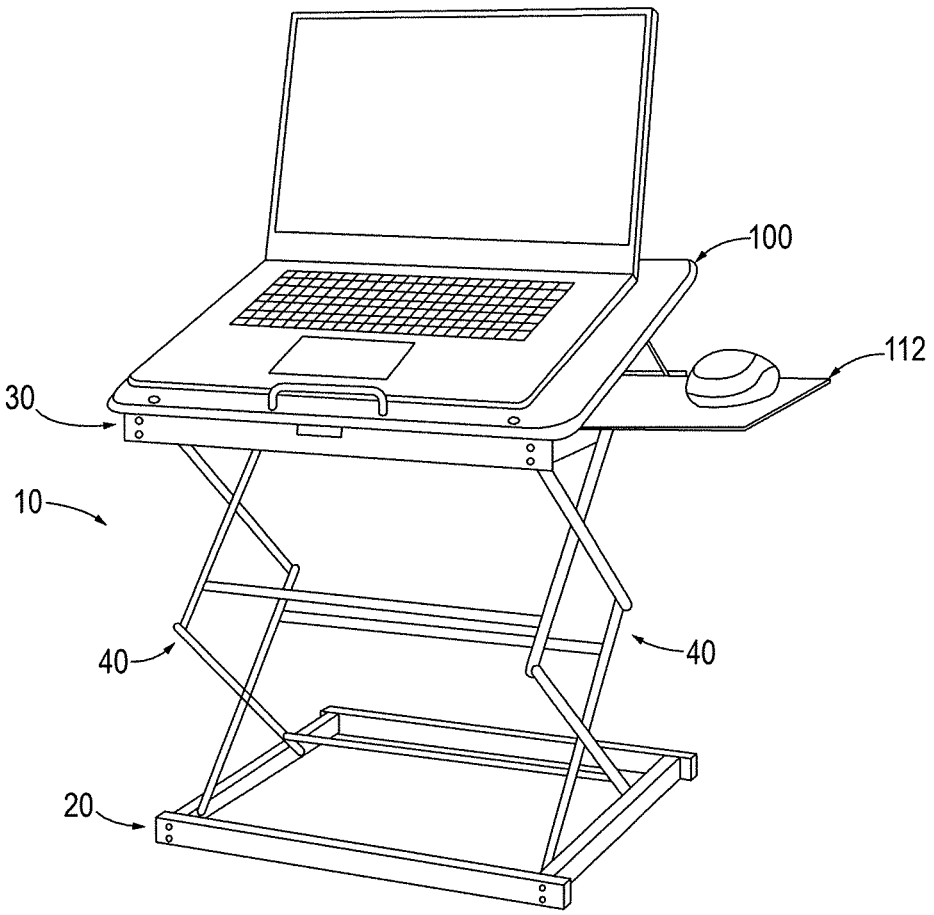
FIG. 9 shows a view of the stand supporting a laptop computer and a mouse device in accordance with aspects of the invention.

According to even further aspects of the invention, the adjustable height stand 10 may be used separate from the case 12. For example, as shown in FIG. 9, the bottom frame 20 of the adjustable height stand 10 may be placed on a flat surface such as a table top or desk top, and the adjustable height stand 10 may be operated in the manner described herein but without being connected to a case.

Figure 10:
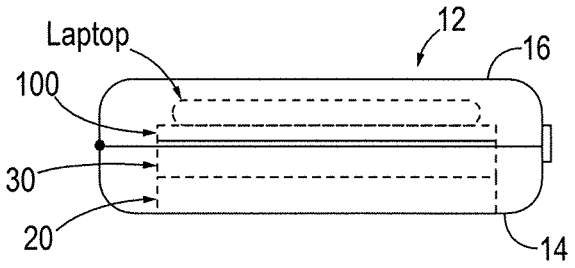
FIG. 10 shows the stand inside the bag in accordance with aspects of the invention.

FIG. 10 shows the stand 10 inside the bag 12 in accordance with aspects of the invention. As described herein, the stand 10 may be sized and shaped to fit inside the bag 12 when the bag is closed and when the stand is in the fully collapsed position. In a particular embodiment, the stand 10 and the case 12 are sized and shaped such that the stand 10 and a computer device (e.g., a laptop computer) fit inside the bag 12 when the bag is closed and when the stand is in the fully collapsed position. In this manner, the stand and laptop can be carried in the bag.

According to another embodiment of the invention, the platform 100 is connected to the top frame 30 in a manner such that the platform 100 is fixed at a constant tilt angle relative to the top frame 30. In this embodiment, the tilt angle of the platform 100 relative to the top frame 30 is not adjustable. The constant tilt angle may be horizontal or some other predefined angle relative to horizontal.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A system, comprising:

a case comprising a first part pivotally connected to a second part, wherein the first part and the second part are configurable in a first case position in which the case is closed, and the first part and the second part are configurable in a second case position in which the case is open;

an adjustable stand connected to an interior of the case, the adjustable stand comprising: a bottom frame connected to the case; a top frame connected to the bottom frame via at least one height adjustment system; and a platform connected to the top frame;

wherein the height adjustment system permits the top frame to be moved vertically relative to the bottom frame to position the top frame at one of plural predefined heights relative to the bottom frame; and the bottom frame is connected to the case by connectors that permit the stand to be selectively connected to, and disconnected from, the case.

2. The system of claim 1, wherein the case comprises one of a briefcase and a bag.

3. The system of claim 1, wherein:

the stand is collapsible to a first stand position in which the stand fits completely inside the case when the case is closed; and the stand is moveable from the first stand position to a second stand position in which the stand extends upward out of the case when the case is open.

4. The system of claim 1, wherein the height adjustment system comprises at least one scissor mechanism that is operatively connected between the bottom frame and the top frame.

5. The system of claim 4, further comprising a locking mechanism that selectively locks the at least one scissor mechanism at one of plural predefined positions, wherein respective ones of the plural predefined positions correspond to respective ones of the plural predefined heights.

6. The system of claim 5, wherein the locking mechanism comprises an element that, when actuated by a user, unlocks the locking mechanism and permits lowering the top frame relative to the bottom frame.

7. The system of claim 1, further comprising:

an auxiliary platform; and an attachment system connected to the stand, wherein the attachment system permits the auxiliary platform to be selectively connected to, and disconnected from, the stand.

8. The system of claim 7, wherein:

a top surface of the auxiliary platform is in a substantially horizontal orientation when the auxiliary platform is connected to the stand via the attachment system;

the top surface of the auxiliary platform remains in a substantially horizontal orientation when the top frame is moved vertically relative to the bottom frame; and the top surface of the auxiliary platform remains in a substantially horizontal orientation when the platform is rotated relative to the top frame.

9. The system of claim 1, further comprising:

a platform support pivotally connected to the platform; and plural stops on the top frame, wherein the platform is rotatable relative to the top frame such that the platform can be positioned at one of plural predefined tilt-angles relative to the top frame;

the platform support engages a first one of the plural stops when the platform is at a first one of the plural predefined tilt-angles;

the platform support engages a second one of the plural stops when the platform is at a second one of the plural predefined tilt-angles; and the platform support does not engage any of the plural stops when the platform is at a third one of the plural predefined tilt-angles.

10. The system of claim 1, wherein the platform is fixed at a constant tilt angle relative to the top frame.

11. A system, comprising:

an adjustable stand configured to be connected to an interior of a case, the adjustable stand comprising: a bottom frame; a top frame connected to the bottom frame via at least one height adjustment system; and a platform connected to the top frame; and plural connectors configured to be connected to an interior of the case, wherein the plural connectors, when connected to the case, are configured to selectively receive and retain the bottom frame of the stand, such that the connectors are structured and arranged to selectively connect the stand to, and disconnect the stand from, the case, the platform is rotatable relative to the top frame such that the platform can be positioned at one of plural predefined tilt-angles relative to the top frame; and the height adjustment system permits the top frame to be moved vertically relative to the bottom frame to position the top frame at one of plural predefined heights relative to the bottom frame.

12. The system of claim 11, wherein the height adjustment system comprises at least one scissor mechanism that is operatively connected between the bottom frame and the top frame.

13. The system of claim 12, further comprising a locking mechanism that selectively locks the at least one scissor mechanism at one of plural predefined positions, wherein respective ones of the plural predefined positions correspond to respective ones of the plural predefined heights.

14. The system of claim 13, wherein the locking mechanism comprises an element that, when actuated by a user, unlocks the locking mechanism and permits lowering the top frame relative to the bottom frame.

15. The system of claim 11, further comprising:

an auxiliary platform; and an attachment system connected to the stand, wherein the attachment system permits the auxiliary platform to be selectively connected to, and disconnected from, the stand.

16. The system of claim 15, wherein:

a top surface of the auxiliary platform is in a substantially horizontal orientation when the auxiliary platform is connected to the stand via the attachment system;

the top surface of the auxiliary platform remains in a substantially horizontal orientation when the top frame is moved vertically relative to the bottom frame; and the top surface of the auxiliary platform remains in a substantially horizontal orientation when the platform is rotated relative to the top frame.

17. The system of claim 11, further comprising:

a platform support pivotally connected to the platform; and plural stops on the top frame, wherein the platform support engages a first one of the plural stops when the platform is at a first one of the plural predefined tilt-angles;

the platform support engages a second one of the plural stops when the platform is at a second one of the plural predefined tilt-angles; and the platform support does not engage any of the plural stops when the platform is at a third one of the plural predefined tilt-angles.

18. A system, comprising:

an adjustable stand comprising: a bottom frame; a top frame connected to the bottom frame via at least one height adjustment system; and a platform connected to the top frame;

an auxiliary platform; and an attachment system connected to the stand, wherein the attachment system permits the auxiliary platform to be selectively connected to, and disconnected from, the stand, wherein the platform is rotatable relative to the top frame such that the platform can be positioned at one of plural predefined tilt-angles relative to the top frame;

the height adjustment system permits the top frame to be moved vertically relative to the bottom frame to position the top frame at one of plural predefined heights relative to the bottom frame;

a top surface of the auxiliary platform is in a substantially horizontal orientation when the auxiliary platform is connected to the stand via the attachment system;

the top surface of the auxiliary platform remains in a substantially horizontal orientation when the top frame is moved vertically relative to the bottom frame; and the top surface of the auxiliary platform remains in a substantially horizontal orientation when the platform is rotated relative to the top frame.

19. The system of claim 18, wherein the height adjustment system comprises at least one scissor mechanism that is operatively connected between the bottom frame and the top frame, further comprising a locking mechanism that selectively locks the at least one scissor mechanism at one of plural predefined positions, wherein respective ones of the plural predefined positions correspond to respective ones of the plural predefined heights, wherein the locking mechanism comprises an element that, when actuated by a user, unlocks the locking mechanism and permits lowering the top frame relative to the bottom frame.

20. The system of claim 18, further comprising:

a platform support pivotally connected to the platform; and plural stops on the top frame, wherein the platform support engages a first one of the plural stops when the platform is at a first one of the plural predefined tilt-angles;

the platform support engages a second one of the plural stops when the platform is at a second one of the plural predefined tilt-angles; and the platform support does not engage any of the plural stops when the platform is at a third one of the plural predefined tilt-angles.

21. The system of claim 1, wherein the top frame comprises: a first top side rail; a second top side rail; a top front rail affixed to each of the first top side rail and the second top side rail; and a top rear rail affixed to each of the first top side rail and the second top side rail.

22. The system of claim 1, wherein;

the platform is rotatably connected to the top frame by at least one hinge having an axis of rotation; and the first part of the case is pivotally connected to the second part of the case about a second axis that is substantially parallel to the axis of rotation of the at least one hinge.

23. The system of claim 1, wherein:

the top frame comprises: a first top side rail; a second top side rail; a top front rail extending between the first top side rail and the second top side rail in a transverse direction; and the platform is rotatable relative to the top frame along an axis that is substantially parallel to the transverse direction.

24. The system of claim 1, wherein:

the height adjustment system permits the top frame to be moved vertically relative to the bottom frame in a first direction;

a portion of the height adjustment system is slidably connected to the top frame and translates relative to the top frame, in a second direction, when the top frame is moved vertically relative to the bottom frame;

the platform is rotatably connected to the top frame and rotates relative to the top frame about an axis in a third direction; and the first direction, the second direction, and the third direction are all different from one another.

* * * * *